United States Patent [19]

Mantha

[11] 4,022,428

[45] May 10, 1977

[54] LIFT DEVICE

[76] Inventor: Francois J. Mantha, P.O. Box 129, Evain, Temiscamingue County, Quebec, Canada

[22] Filed: Apr. 2, 1976

[21] Appl. No.: 672,890

[52] U.S. Cl. ..... 254/89 R; 187/8.47; 254/127

[51] Int. Cl.[2] ..... B66F 7/12

[58] Field of Search ..... 254/4 R, 4 B, 4 L, 47, 254/89 R, 91, 134, 127; 187/8.47, 8.49, 11

[56] References Cited

UNITED STATES PATENTS

| | | | |
|---|---|---|---|
| 2,564,267 | 8/1951 | Manke | 254/89 R |
| 3,164,275 | 1/1965 | Schatzl et al. | 254/47 |
| 3,271,006 | 9/1966 | Brown et al. | 254/89 R |
| 3,414,087 | 12/1968 | Schmiesing | 254/4 R |
| 3,765,648 | 10/1973 | Rasmussen et al. | 254/47 |

FOREIGN PATENTS OR APPLICATIONS

| | | | |
|---|---|---|---|
| 2,222,030 | 11/1973 | Germany | 254/89 R |

*Primary Examiner*—Al Lawrence Smith
*Assistant Examiner*—Robert C. Watson
*Attorney, Agent, or Firm*—Diller, Brown, Ramik & Wight

[57] ABSTRACT

A lift device having a vertical column securable on a support surface. A support frame is movably secured along at least a portion of the column. A driveable drum is secured in an upper part of the column and a drive assembly, including a drive motor, is coupled to the drum. At least one cable is secured to the drum and the support frame and is of sufficient strength to displace the support frame and a load thereon along the column. In a preferred embodiment, there are two columns spaced apart, whereby a vehicle can be lifted from each side thereof.

21 Claims, 7 Drawing Figures

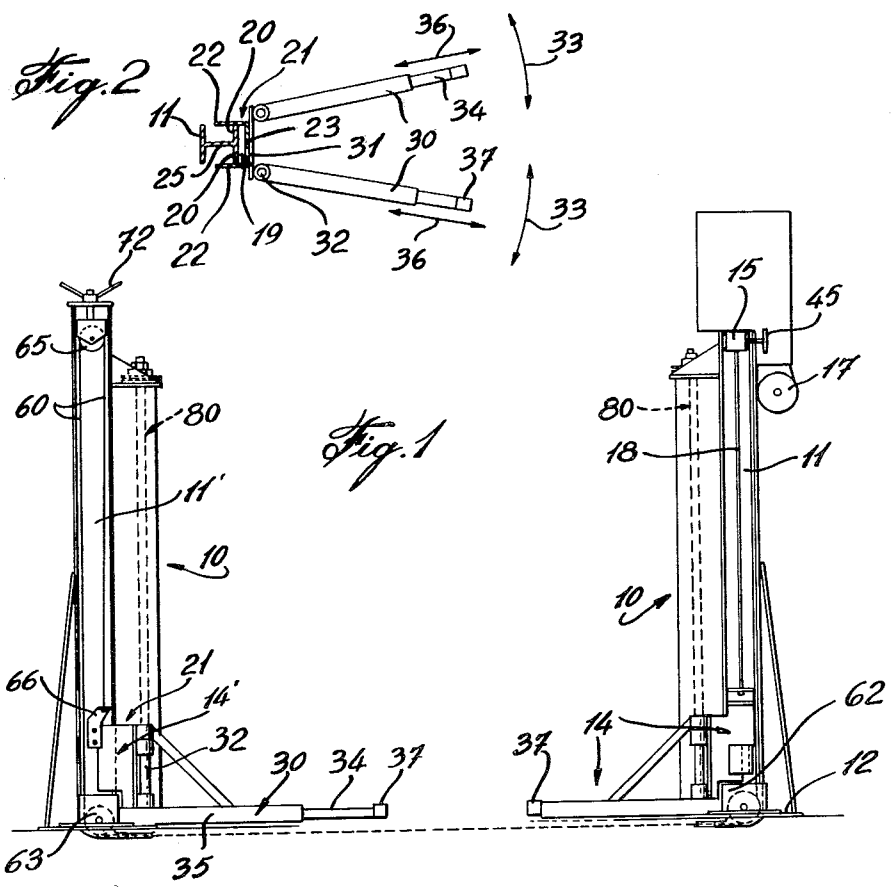
Fig. 1
Fig. 2
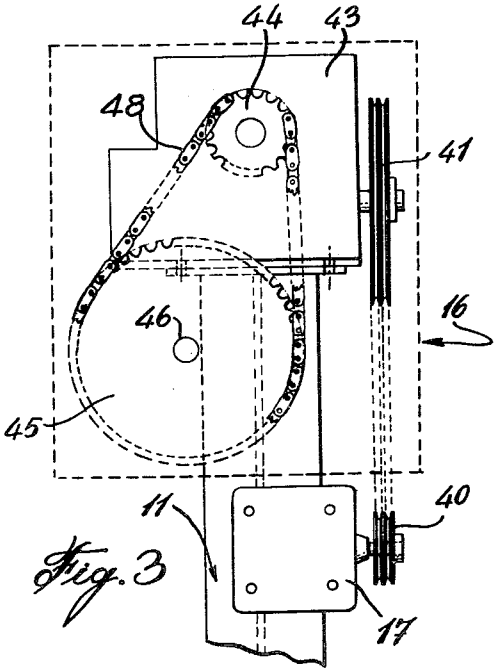
Fig. 3

LIFT DEVICE

BACKGROUND OF THE INVENTION a. Field of the Invention

The present invention relates to a lift device of the type having a vertical column provided with a movable support frame for lifting an object supported thereon and to one side of the column.

More specifically, but not exclusively, the present invention relates to a lift device of the type comprising two spaced apart vertical columns each having a support frame for lifting a vehicle therebetween and above a support surface.

b. Description of the Prior Art

Known lift devices for lifting vehicles are normally of the type having a hydraulic piston secured in a floor and having a support frame at the upper end thereof to engage the undercarriage of a vehicle to lift it up from the ground by hydraulic pressure which causes the cylinder to rise from the ground. In order to install such a lift device, it is necessary to excavate a hole in the ground having approximately 4 feet in diameter and 8 feet in depth. A concrete foundation is poured at the bottom thereof to support the cylinder in the hole. Some of the problems encountered with this type of lift device is that it is sometimes very costly to excavate if one encounters rock and has to blast a hole in a service station. Further, the support cylinder of such device is normally positioned centrally of a work area and is therefore an obstruction to a person working under the vehicle. Still further, the support frame being supported from the center of the undercarriage of the vehicle extends over certain parts of undercarriage of the vehicle which are required to be serviced, such as the transmission, muffler, etc., and thus being cumbersome. Still further, such lift devices require periodic servicing or maintenance to make sure that it operates satisfactorily. It is also necessary to purchase a compressor whereby to make the cylinder function. Thus, this type of lift device is costly to install and maintain.

Another type of lift device known is that utilizing two vertical columns, each having a support frame which is movable along the column whereby to lift a vehicle from opposed sides and between the columns above a support surface. With this type of lift device, there is no obstruction under the vehicle when it is lifted by the support frames. However, a disadvantage of such known type of vertical column lift device is that it is very costly to construct and utilizes large motors to drive a threaded bolt which displaces the support frames. Still further, the support frames are interconnected to each other by a linkage extending above a support surface thus causing an obstacle on the support surface between the two vertical columns. Such obstacle is hazardous to a person repairing a vehicle particularly when the person is holding an instrument in his hands. Furthermore, the drive motors for such devices are considerably large, utilize high voltages not normally available in service stations and costly. The manner in which the support members are raised is further complicated and expensive to construct. Still further, the safety features of such known device are not satisfactory, and the lift operates very slowly.

SUMMARY OF THE INVENTION

It is a feature of the present invention to provide a lift device which overcomes substantially all of the above-mentioned disadvantages.

It is a further feature of the present invention to provide a lift device incorporating a one-and-a-half horsepower motor as the source of drive for the lift which is capable of lifting a load of at least 6,000 pounds.

It is a further feature of the present invention to provide a lift device incorporating a safety mechanism which will support a vehicle engaged by the lift device in the event the drive assembly becomes uncoupled from the support frame.

It is a still further feature of the present invention to provide a lift device which is easy to install, requires very little maintenance, is economical to use and which permits an operator to move more freely under a vehicle supported thereby and without obstacle on the support surface below the vehicle.

According to the above features, from a broad aspect, the present invention provides a lift device having a vertical column securable on a support surface. A support frame is movably secured along at least a portion of the column. A driveable drum is secured in an upper part of the column and a drive assembly, including a drive motor, is coupled to the drum. At least one cable is secured to the drum and the support frame and is of sufficient strength to displace the support frame and a load thereon along the column.

An elongated bolt is supported adjacent the column for free axial rotation. The bolt has a helical thread along at least a portion thereof. A connector is secured to the support frame and is in threaded engagement with the bolt. The bolt supports the support frame when the cable fails to support the support frame.

BRIEF DESCRIPTION OF THE DRAWINGS

A preferred embodiment of the present invention will now be described with reference to the accompanying drawings in which:

FIG. 1 is a side view of a lift device constructed in accordance with the present invention and comprising two vertical columns each having a support frame;

FIG. 2 is a top cross-section view of the column and the support frame;

FIG. 3 is a fragmented side view illustrating the drive assembly of the lift device;

DESCRIPTION OF THE PREFERRED EMBODIMENTS

Figure 4:
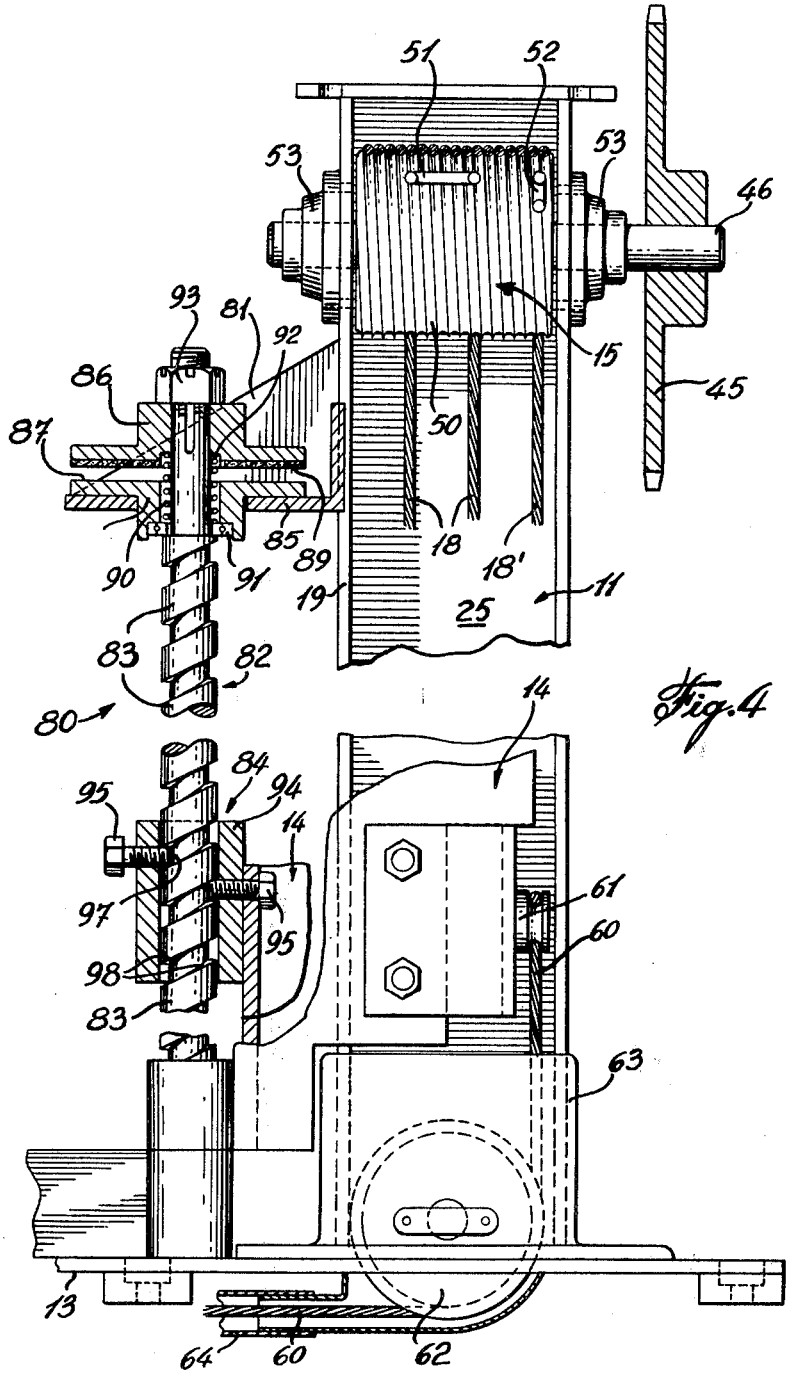
FIG. 4 is a fragmented side view, partly in section, of a vertical column showing the construction of the safety mechanism associated therewith.

Referring now to the drawings, and more particularly to FIGS. 1 and 2, there is shown generally at 10, the lift device of the present invention. The lift device 10 comprises basically a vertical column 11 which is securable by a base frame 12 on a support surface 13. A support frame, generally shown at 14, is movably secured along the column 11 in a manner which will be described below. A driven drum 15 is secured in an upper part of the column 11. A drive assembly 16 (see FIG. 3) is also located in the upper part of the column 11 and includes a drive motor 17 which is coupled via the drive assembly to the drum 15. At least one cable 18 is secured to the drum 15 and the support frame 14 and is of sufficient strength to displace the support frame 14 and a load engaged thereby (not shown) along the column 11.

As more clearly shown in FIG. 2, the column 11 is a steel H-beam having a flat wall 19 which defines opposed arms 20. The support frame 14 consists of a U-shaped attachment bracket 21 defining opposed parallel side walls 22 and a transverse connecting wall 23. Support wheels or roller bearings 24 (see FIG. 5) are secured to a respective one of the side walls 22 whereby one roller bearing is in contact with the front surface of the flat wall 19 or arm 20 and the other is in contact with the rear surface of the flat wall 19 or the same arm 20. Thus, each arm has a roller bearing moving on each face thereof whereby the U-shaped bracket 21 is captive and displaceable along the flat wall 19.

As shown in FIGS. 1 and 2, the support frame 14 comprises at least one support arm 30, in this embodiment two arms 30 are shown, which are secured to the U-shaped bracket 21 via a connecting plate 31. As hereinshown, one end of each support arm 30 is secured to the plate 31 by a pivot rod 32, and in a known manner, whereby the arms 30 can swing in the direction of arrows 33 not to provide obstruction between two columns or the side of the column where a load is to be lifted. Further each support arm 30 has an extension arm 34 which is telescopically received within a hollow tubular arm portion 35 whereby to make the support arm adjustable longitudinally in the direction of arrows 36. A support head 37 is secured at the free end of the extension arm 34 to engage a specific portion of the undercarriage of a vehicle to be lifted by the device.

As hereinabove mentioned, to cause displacement of the support frame 14 along the column 11, there is provided a drive assembly 16 which is shown in FIG. 3. The drive assembly includes the motor 17, having its output sheave 40 coupled to the input sheave 41 of a gear reduction mechanism 43. Gear reduction mechanism 43 has an output toothed gear 44 which is coupled to a toothed drive gear 45 by means of a link chain 48. The drive gear 45 is secured to the drum shaft 46 of the drum 15. The r.p.m. of the motor 17 is greatly reduced by the gear reduction mechanism and the ratio between the sheaves and gears, the total reduction ratio being approximately in the order of 40:1.

Referring now to FIG. 4, there is shown the construction of the drum 15. The drum 15 has a helical guide trough 50 on its outer surface whereby to guide the cables 18 to form helical windings about the drum 15. As hereinshown, the three cables 18 are secured to the drum through securement slots 51 and 52 provided in the drum. One of the cables 18' is attached in a slip-free manner within the slot 52 and in a manner well known in the art. The two other cables 18 are each formed by a single cable length which is attached in slot 51 by looping it around an abutment in the slot, thus forming two downwardly extending cable sections. The drum is secured to the column 11 on bearings (not shown) located in bearing housings 53 which are secured to a suitable support frame whereby the cables 18 will travel down the H-beam adjacent the transverse wall 25. The free ends 26 of the cables 18 (see FIG. 5) are secured via respective lugs 27 to a securement bracket 28 attached to a side wall 22 of the support frame 14. The three cables 18 are wound on the drum 15 simultaneously at the same rate. The diameter of the cables 18, and the diameter of the drum 15 are selected with relation to the strength of the motor and the maximum load rating of the support frame.

As shown in FIG. 1, a lift may be constructed with two vertical columns 11, the further column being identified by numeral 11'. A further support frame 14' is also movably secured along the further column 11'. A further cable 60 (see FIGS. 3 and 4) is secured to an attachment post 61 fixed to the support frame 14 and extends to the further column 11' by engaging a guide pulley 62 in a base 63 of each column 11 and 11'. As shown in FIG. 4, the cable 60 extends in a casing 64 which is positioned in a trench disposed below the support surface 13.

The column 11' is provided with a top pulley 65 secured in an upper part of the column and the cable 62 extends upwardly along the column and about the top pulley 65 and then downwardly to be secured at its free end to the securement bracket 66 secured to the support frame 14'. Thus, as the support frame 14 of column 11 is raised by the rotation of the drum 15, the cable 60 will move up with the support frame 14 thus causing the support frame 14' of the column 11' to also move up at the same rate and in horizontal alignment with the support frame 14. The top pulley 65 is secured in an adjustable manner whereby the cable 60 may be made taut by taking any slack out of it when adjusting both support frames 14 and 14' laterally to lie in the same horizontal plane.

Figure 6:
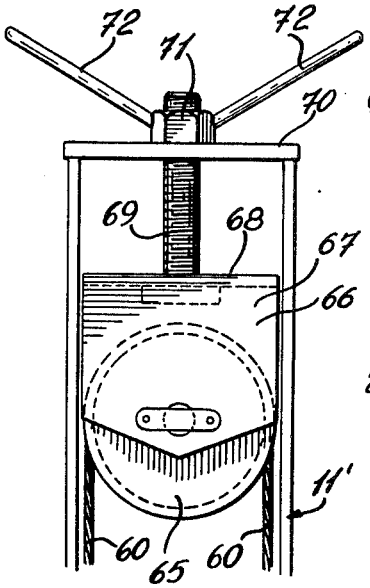
FIG. 6 is a fragmented top view of a vertical column illustrating the adjustable pulley.

As shown in FIG. 6, the top pulley 65 is secured between the side walls 66 of a U-shaped bracket 67. The top wall 68 of the bracket 67 has a threaded bolt 69 extending vertically therefrom and through a hole (not shown) provided in a top wall 70 of the column 11'. A nut 71 is threaded at the free end of the bolt 69 and provided with wings 72 to permit rotation of the nut 71 and thus vertical adjustment of the pulley 65.

Figure 5:
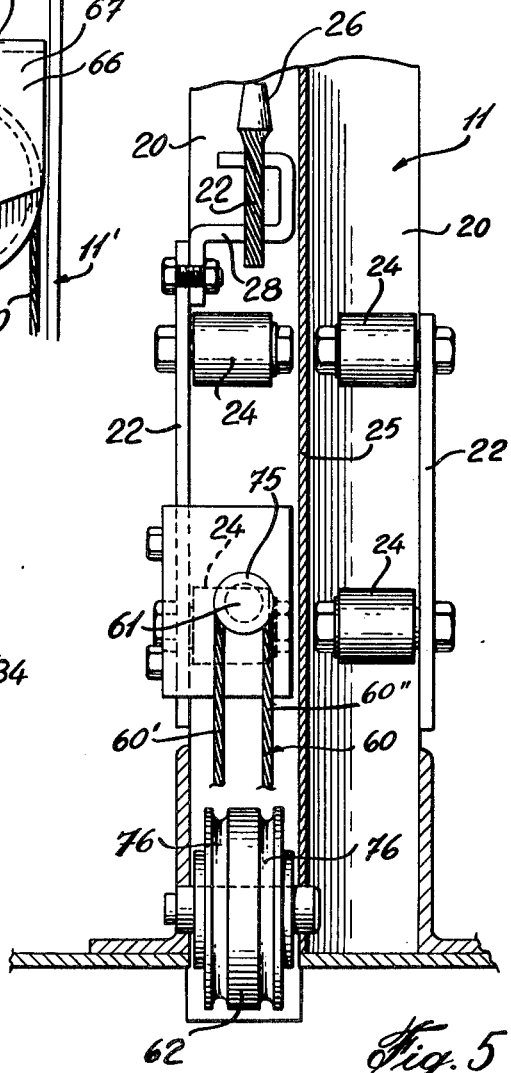
FIG. 5 is a fragmented side view of a lower portion of a vertical column from the rear thereof and illustrating the manner in which the support frame is secured to the vertical column.

Referring to FIG. 5, it can be seen that the further cable 60 is provided with a looped end 75 looped about the attachment post 61 thus defining two cable length sections 60' and 60'' extending side-by-side about the guide pulleys 62 and the top pulley 65 which are double-grooved as shown at 76 in FIG. 5 to guide each of the cable length sections. The free ends of the cable 60 are secured to the bracket 66 as described above.

Referring again to FIG. 1, it can be seen that the columns 11 and 11' are secured in spaced-apart relationship to permit a passenger vehicle (not shown) to be positioned therebetween over the support surface 13. Both support frames 14 and 14' are movable to engage the vehicle undercarriage (not shown) and are displaceable to lift a vehicle to a sufficient height to permit a person to walk thereunder or to permit the positioning of a further vehicle under the lifted vehicle when emergency repair is required to be made to such further vehicle. Although there is hereinshown a lift device consisting of two support columns 11 and 11', it is to be understood that the lift device incorporating column 11 may be used solely for different lifting applications and the lift could comprise a single column with the drive assembly.

Once the vehicle is supported by the support frames 14 in an elevated position, it is necessary to provide a safety mechanism in the event the cable 18 fails to support the support frame due to a cable breakage or a decoupling of any of the gears, sheaves or belt or chain connection in the drive assembly 16. A safety mechanism 80 (see FIG. 1) is provided to prevent such accidents. It is also noted that the safety mechanism could be used with any type vertical support post lift devices having a column and a displaceable support structure.

Referring to FIG. 4, there is illustrated the construction of the safety mechanism 80. The mechanism 80 is secured adjacent the column 11 between a bracket 81 which is attached to the flat wall 19 of the H-beam 11 and a connector 84 attached to the support frame 14. The safety mechanism comprises an elongated threaded safety bolt 82 having a helical thread 83 along a portion thereof. The saftey bolt 82 is supported for free axial rotation along its longitudinal axis, the axial rotation being imparted thereto by means of the connector 84 which is secured to the support frame 14 and which is in threaded engagement with the safety bolt 82. As the support frame is displaced along the column 11, the connector 84 will move along the bolt 82 causing the bolt to rotate freely in the axial direction.

The top end of the safety bolt 82 extends through a horizontal wall 85 of the support bracket 81 A support plate 86 is secured to the top portion of the bolt 82 and is disposed above a support face 87 of a support plate 88 which is secured to the horizontal wall 85. The support plate 86 is a circular support disc having a friction surface 89 on a lower face thereof. The support face 87 of the support bracket 88 is an engageable disc having a flat upper surface. A coil spring 90 maintains the friction surface 89 above and spaced from the upper flat surface 87 of the disc 88. The spring 90 is positioned about the bolt 82 between a support bearing 91 and an annular cavity 92 formed in the support plate 86 about the shaft. An adjustable nut 93 is provided at the end of the bolt for adjusting the spacing between the friction surface 89 and the support face 87.

Figure 7:
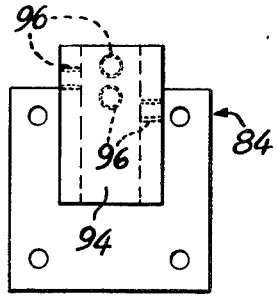
FIG. 7 is a plan view of the connector secured to the support frame.

The connector 84 consists of an open-ended hollow housing 94. Thread engaging means in the form of two or more diagonal bolts 95 extend in threaded bores 96 (see FIG. 7) which are diagonally opposed and offset. As shown in FIG. 7, there are four bores 96 to receive four such bolts 95. Each bolt 95 has a thread engaging free end 97 which is positioned in close frictional contact between opposed side walls 98 of the thread 83 of the safety bolt 82. Thus, as the connector 84 is moved along the bolt 82, the bolts 95 will cause the safety bolt 82 to rotate. The safety bolt 82 and bolts 95 and all couplings thereto are of sufficient strength to support at least six times the maximum permissible load to be supported on the support frame 14.

In operation of the lift, as the support frame 14 is raised by the cables 18, the connector 84 moves along the bolt 82 and causes it to rotate due to its threaded engagement. The support disc 86 secured to the bolt 82 also rotates and remains in spaced-apart relation to the support bracket 88. If the cable or cables 18 or any portion of the linkage in the drive assembly fails, the load resting on the support frame 14 will cause the frame to drop but only slightly as the friction disc 89 will engage the support face 87 of the support bracket 88 after being displaced a short distance of less than an inch. Because the bolt 82 has a helical thread 83, the weight of the load will have a tendency to cause rotation of the bolt at the instant the friction disc comes in contact with the support face 87. However, the friction disc will start rotating and act as a brake shoe thus causing only a small rotation in the bolt whereby failure of the linkage will not cause an abrupt or appreciable drop of the load but a dampened shock due to the braking action of the friction disc 89. All of the support structure of the safety mechanism 80 and the vertical column 11 and support frame 14 is constructed such as to support at least six times the maximum load rating to be lifted by the support frame.

The motor 17 is a one-and-a-half horsepower electric motor which is operated by a push-button switch (not shown). A safety feature requires that the operator maintains the push-button depressed to cause operation of the motor 17. Thus, when the push-button is released, the motor 17 will stop and the support frame will come to a halt. A safety switch is also incorporated in the system to cut off the drive of the motor when the support frame has reached its maximum travel at each end of the support column.

The turn ratio per minute between the output of the motor 17 and the output of the drum 15 is 1725/7.

The columns 11 are secured to the support surface 13, which could be a concrete, asphalt or rock surface, by eight rock bolts. Installation is less than half a day for a two column lift system and the electric installation for the motor only requires the normal 110 or 220 volt supply that one finds in almost every service station. Also, all the bearings are seal bearings, thus requiring very little maintenance. The reduction gear box 43 is self-lubricating and provided with an oil reservoir. Also, because of the small size of the motor, very little hydro electric power is consumed by the device. Thus, the cost of operation is greatly reduced.

It is within the ambit of the present invention to incorporate in this description any obvious modifications provided these fall within the scope of the invention as broadly defined by the accompanying claims.

I claim:

1. A lift device comprising a vertical column securable on a support surface, a support frame movably secured along at least a portion of said column, a driveable drum secured in an upper part of said column, a drive assembly including a drive motor coupled to said drum, at least one cable secured to said drum and said support frame and of sufficient strength to displace said support frame and load thereon along said column when said drum is rotated, an elongated bolt supported adjacent said column for free axial rotation, said bolt having a helical thread along at least a portion thereof, and a connector secured to said support frame and is in threaded engagement with said bolt, said bolt supporting said support frame when said at least one cable fails to support said support frame.

2. A lift device as claimed in claim 1, wherein said column comprises a steel beam having an elongated flat wall, said support frame being connected to said flat wall by support wheels positioned on a front and back side of said flat wall, said support frame having at least one support arm extending transverse to said vertical column.

3. A lift device as claimed in claim 2, wherein said support frame further comprises a U-shaped attachment bracket defining opposed parallel side walls and a transverse connecting wall, said support wheels being roller bearings secured transverse to a respective one of said side walls and in contact with said front and back side of said flat wall whereby said attachment bracket is captive and displaceable on said flat wall by said roller bearings, said at least one support arm being pivotally secured to said transverse connecting wall.

4. A lift device as claimed in claim 3, wherein said at least one support arm is a telescopic extensible support arm having a horizontal support bracket at a free end thereof.

5. A lift device as claimed in claim 2, wherein said drive assembly further comprises a gear reduction mechanism coupled to said drive motor and said drum, said drum being secured to a shaft having a toothed drive gear which is chain coupled and driven from an output toothed gear of said gear reduction mechanism in a manner whereby the r.p.m. of said motor to said toothed drive gear is greatly reduced.

6. A lift device as claimed in claim 5, wherein said drum has three steel cables secured thereto, the free end of each said cables being secured to said support frame, said cables being secured in spaced-apart relationship on said drum whereby said cables are wound on said drum simultaneously, said cables being of sufficient tensile strength to lift at least the maximum load to be lifted by said support frame.

7. A lift device as claimed in claim 1, wherein there is further provided a further vertical column securable on said support surface, a further support frame movably secured along said further column, a further cable secured to said support frame and extending to said further column by engaging a guide pulley in a base of each column, a top pulley in an upper part of said further column, said further cable extending upwardly along said further column and about said top pulley and then downwardly to be secured at its free end to said further support frame whereby both said support frames will be displaced simultaneously at a substantially equal rate and in substantially horizontal alignment along their respective column by said drum when rotated.

8. A lift device as claimed in claim 7, wherein said top pulley is secured in a bracket which is adjustably secured to said further column for vertical displacement whereby to maintain said further cable taut.

9. A lift device as claimed in claim 8, wherein there are two of said further cables each of which extends side-by-side, said guide pulleys and top pulley being double-grooved to guide each of said two further cables.

10. A lift device as claimed in claim 8, wherein said further cable has opposed ends thereof secured to said further support frame thus forming a loop to define two side-by-side cable length sections and an integral end, said guide pulley and top pulley being double-grooved to guide each of said cable length sections, said integral end being looped about an attachment post secured to said support frame.

11. A lift device as claimed in claim 7, wherein said columns are secured in spaced-apart relationship on said support surface to permit a passenger vehicle to be positioned therebetween on said support surface, said further cable extending under said support surface in a cable housing and displaceable longitudinally therein, said support frame of both columns being capable of engagement of said vehicle from the underside thereof and said columns being of sufficient height to cause said vehicle to be lifted between said columns to a height sufficient to permit a person to walk thereunder.

12. A lift device as claimed in claim 1, wherein a portion of said bolt extends through a support bracket secured to said column, a support plate secured to said bolt and disposed above a support face of said support bracket, said support plate resting on said support face and supporting said bolt and the load on said support frame when said at least one cable fails to support said support frame.

13. A lift device as claimed in claim 12, wherein said support plate is a circular support disc having a friction surface on a lower face thereof, said support face of said support bracket being on engageable disc having an upper flat surface, a separator coil spring positioned about said portion of said bolt extending through said support bracket to maintain said friction surface above and spaced from said upper flat surface of said engageable disc.

14. A lift device as claimed in claim 13, wherein said connector is a hollow open-ended housing, thread engaging means secured in said open-ended housing and in threaded engagement with said bolt, said connector transferring the load of said support frame onto said bolt when said cable fails to support said support frame whereby said bolt which be displaced axially downward and compress said separator coil spring with said friction surface brought in contact with said upper flat surface of said engageable disc, said support disc being given a rotational torque by the load on said support frame acting on said bolt through said thread engaging means whereby said support frame will be displaced a short distance downwardly in a damped manner when said cable fails to support said support frame and its load.

15. A lift device as claimed in claim 14, wherein said thread engaging means is at least two diagonal bolts havinga thread engaging free end in close frictional contact between opposed side walls of the thread of said bolt.

16. A lift device comprising a vertical column securable on a support surface, a support frame movably secured along said column, a drive assembly including a drive motor coupled to said support frame for displacing said support frame along said column, a safety mechanism secured adjacent said column, said safety mechanism having an elongated bolt with a helical thread along at least a portion thereof, said bolt being supported adjacent said column for free axial rotation, and a connector secured to said support frame and in threaded engagement with said bolt, said bolt supporting said support frame when said drive assembly becomes uncoupled to said support frame.

17. A lift device as claimed in claim 16, wherein a portion of said bolt extends through a support bracket secured to said column, a support plate secured to said bolt and disposed above a support face of said support bracket, said support plate resting on said support face and supporting said bolt and the load on said support frame when said drive assembly becomes uncoupled from said support frame.

18. A lift device as claimed in claim 17, wherein said support plate is a circular support disc having a friction surface on a lower face thereof, said support face of said support bracket being an engageable disc having an upper flat surface, a separator coil spring positioned about said portion of said bolt extending through said support bracket to maintain said friction surface above and spaced from said upper flat surface of said engageable disc.

19. A lift device as claimed in claim 18, wherein said connector is a hollow open-ended housing, thread engaging means secured in said open-ended housing and in threaded engagement with said bolt, said connector transferring the load of said support frame onto said bolt when said drive assembly becomes uncoupled from said support frame whereby said bolt will be displaced axially downward and compress said separator coil spring with said friction surface brought in contact with said upper flat surface of said engageable disc, said support disc being given a rotational torque by the load on said support frame acting on said bolt through said thread engaging means whereby said support frame will be displaced a short distance downwardly in a damped manner when said drive assembly becomes uncoupled from said support frame.

20. A lift device as claimed in claim 19, wherein said thread engaging means is at least two diagonal bolts having a thread engaging free end in close frictional contact between opposed side walls of the thread of said bolt.

21. A lift device as claimed in claim 16, wherein there is further provided a further vertical column securable on said support surface, a further support frame movably secured along said further column, drive coupling means between said columns to displace said further support frame whereby both said support frames will be displaced simultaneously at substantially equal rate, and in substantially horizontal alignment, along their respective column by said drive assembly.

* * * * *